United States Patent [19]

Williams

[11] 4,160,653

[45] Jul. 10, 1979

[54] FLUID BED SEPARATOR APPARATUS FOR PROCESSING WASTE MATERIAL TO RECOVER BURNABLES

[76] Inventor: Robert M. Williams, 16 La Hacienda, Ladue, Mo. 63124

[21] Appl. No.: 890,042

[22] Filed: Mar. 27, 1978

[51] Int. Cl.[2] ..... C02C 1/18

[52] U.S. Cl. ..... 55/315; 55/340; 55/466; 210/173

[58] Field of Search ..... 210/152, 173, 251, 258, 210/259, 298, 512; 55/315, 340, 430, 466

[56] References Cited

U.S. PATENT DOCUMENTS

| | | | |
|---|---|---|---|
| 940,076 | 11/1909 | Seaver | 55/315 X |
| 1,873,394 | 8/1932 | Hallam | 210/173 X |

FOREIGN PATENT DOCUMENTS

| | | | |
|---|---|---|---|
| 455604 | 10/1936 | United Kingdom | 210/173 |

*Primary Examiner*—John Adee

*Attorney, Agent, or Firm*—Gravely, Lieder & Woodruff

[57] ABSTRACT

Apparatus for processing domestic and industrial trash and garbage to recover the components that have fuel values by moving the trash and garbage through a fluid bed where it is shredded to a desired size while in the fluid bed, and subsequently causing it to flow in an air lift at a low velocity so that the recoverable light weight components can be separated from the heavy components and collected through a cyclone separator, the heavy components being carried off by suitable conveyor means. The apparatus embodies a system of air moving means and conduits with control valves so that the fluid bed separator is operated at a negative pressure to assure a dust free environment for the apparatus and obtain an even distribution of the shredded material in a moving air stream at a low velocity so the material will separate on the difference in specific gravity, assisted by air elutriation.

8 Claims, 3 Drawing Figures

FLUID BED SEPARATOR APPARATUS FOR PROCESSING WASTE MATERIAL TO RECOVER BURNABLES

BACKGROUND OF THE INVENTION

Heretofore, the usual apparatus or system for processing waste material to recover the components having fuel value involved feeding the waste material to a shredder or grinder, such as a hammer mill, collecting the hammer mill output on a conveyor which dumps the material in a bin and from the bin by an elevating means or drag chain to a vibrating feeder to again spread out the material before delivering it through an air lock to an elutriating chamber or air lift.

In such usual apparatus, the hammer mill and elutriating chamber or air lift are separate units of the system, and require interconnecting means to transfer the output from the hammer mill to the elutriating chamber. The condition of the waste material is usually such that it contains a fair amount of moisture, especially the garbage portion which gets scrambled up with the paper, wood, cloth and similar components. The moisture is not driven off and so remains in the system, and each time the material is transported it sticks together or agglomerates and forms large masses which must be broken down as the material is delivered through a rotary distribution device to the elutriating chamber or air lift.

BRIEF DESCRIPTION OF THE INVENTION

This invention is directed to apparatus for processing waste material to separate out and recover the portions having a useful fuel value, the separating being carried out in fluid bed separator apparatus.

The objects of the invention are to improve apparatus for recovering burnables from waste material, to simplify the apparatus by eliminating some components of older apparatus thought to be necessary, to combine in a unique structure the material shredding and elutriating components and supporting components, and to effect a significant saving in cost of a system capable of recovering burnables out of waste material, thereby making it economically feasible to handle waste material for its valuable components rather than to expand land fill sites.

A preferred embodiment of the apparatus comprises a structure having a material receiving hopper open to a casing for a hammer mill, of either one way or reversible type, and a bottom material elutriating chamber, a cyclone separator and its air moving blower, an air lift column connected between the elutriating chamber and the cyclone separator, means to supply air from the air moving blower to the structure so as to by-pass the hammer mill, means to collect material falling out of the elutriating chamber, and means connected to said air moving blower to reduce the pressure within the structure to a level below ambient pressure so that there will be a positive air flow through the hopper, hammer mill, and elutriating chamber to establish a substantially constant velocity in the air lift column through air normally moving through the hammer mill from the hopper, but supplied in by-pass of the hammer mill when required in the event of blinding or clogging of the hammer mill.

BRIEF DESCRIPTION OF THE DRAWINGS

The present apparatus is shown in the following schematic arrangement of components of apparatus in which.

DETAILED DESCRIPTION OF THE APPARATUS

The material to be processed in the present apparatus is domestic and commercial trash having a high percentage of garbage and burnable components which if recovered can be used as a fuel source when separated from metallics and inert material such as ferrous metal, glass and material that by differences in specific gravity can be caused to separate from the components useful as a fuel.

The presently preferred apparatus is embodied in a mill structure 10 provided with a feed hopper 11 to which is connected a conveyor 12 for bringing the trash to the hopper from a suitable source (not shown) where the trash has been prepared by grinding to presize the components and to magnetically extract as much of the ferrous material as possible.

Figure 3:
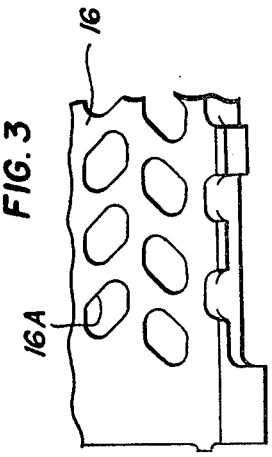
FIG. 3 is a fragmentary view in plan of the grate.

The mill structure 10 is made up of the housing 13 for a hammer rotor 14, breaker bars or plates 15 at opposite sides of the rotor 14 and a grate 16 having openings 16A of a predetermined size to render the material being shredded by the hammers small enough to fall in a substantially even distribution over the entire area of the grate and to rain down into an elutriating chamber 17. The mill structure 10 and the chamber 17 together constitute a fluid bed separator in which the hammer rotor 14 is mounted and submerged to constantly agitate the material until it is shredded down to a size capable of passing through the grate opening 16A. The opening in the grate 16 may be in the form of ovals from about one and one half by three inches to about three by five inches, arranged in a staggered herringbone pattern. A portion of the grate is seen in FIG. 3 to show the openings 16A.

The elutriating chamber 17 has a slanting wall or pan 18, connected adjacent the bottom of the mill housing, and its slanting pan wall 18 extends to an air lock hood 19 associated with the conveyor 20. The conveyor 20 is provided with bars or flights 21 which catch the material after it has fallen into the hood 19 and removes it to a suitable collecting station (not shown). The chamber 17 also is connected to the lower end portion of an air lift column 22 which directs the recoverable material by conduit 23 in an air conveyed stream to a cyclone type separator 24. The action of the cyclone separator 24 is established by the blower 25 which has its suction side connected by conduit 26 to the cupola 27 of the cyclone separator 24. The discharge side of the blower 25 is connected by conduit 28 and a reduced diameter conduit 29 to a bag house unit 30 where dust and fines in the air can be extracted and collected through an air lock valve 31. The air from the bag house is exhausted to atmosphere by fan 32 and its stack 33. The desirable material being processed in the apparatus is collected from the rotary valve 34 for the cyclone separator on a suitable conveyor 35.

The foregoing apparatus includes an air flow conduit 36 which receives the major output from blower 25 and returns or recirculates it to the mill housing 13 where it by-passes the grate 16 and enters the elutriating chamber 17 to improve the distribution, agitation and suspension of the material passing through the grate 16. Approximately two-thirds of the air moved by blower 25 recirculates in conduit 36 to the mill housing 13, and one-third is delivered to the bag house 30 where it is exhausted to atmosphere. The action of the exhaust fan 32 reduces the pressure in the entire system to less than atmospheric or ambient pressure, and is greater than the leakage into the system of air at the hood for feed conveyor 12 or the hood 19 for the discharge conveyor 2. This action places the entire system under negative pressure.

The recirculated air through conduit 36 back to the chamber 17 is effected by a blower 37 having an inlet conduit 38 connected into the hood 12A on conveyor 12, thus maintaining this area under negative pressure. The blower 37 has its outlet conduit 39 connected into the chamber 17 by a first conduit 40 which has a slotted outlet 40A, guarded by a hood 41, open to the upper portion of the chamber 17. In addition, another portion of the conduit 39 is divided into adjacent conduits 42 and 43 which communicate with chamber 17. The conduit 42 supplies a slotted outlet 42A guarded by hood 44, and conduit 43 supplies a slotted outlet 43A guarded by hood 45. In each case the guard hoods 41, 44 and 45 prevent material raining down from the grate 16 entering the slotted outlets 40A, 42A and 43A respectively. The air discharged at slotted outlets 42A and 43A is directed to establish movement or flow of the light weight material toward the air lift column inlet.22A at a low velocity which is important to allow the heavier material time to fall into the air lock hood 19. The action in the fluid bed separator is one of air moving through the mill structure 10 and grate 16 to carry the material into the rotor 14 where it is shredded and reduced to a size capable of passing the grate openings 16A. The material is scrubbed and agitated or elutriated by air sucked into the feed hopper 11, recirculated at the conduit 36 which delivers air to the mill housing 13 at connection 36A and delivered by fan 37 to the slotted outlets 40A, 42A and 43A in the pan wall 18.

Figure 1:
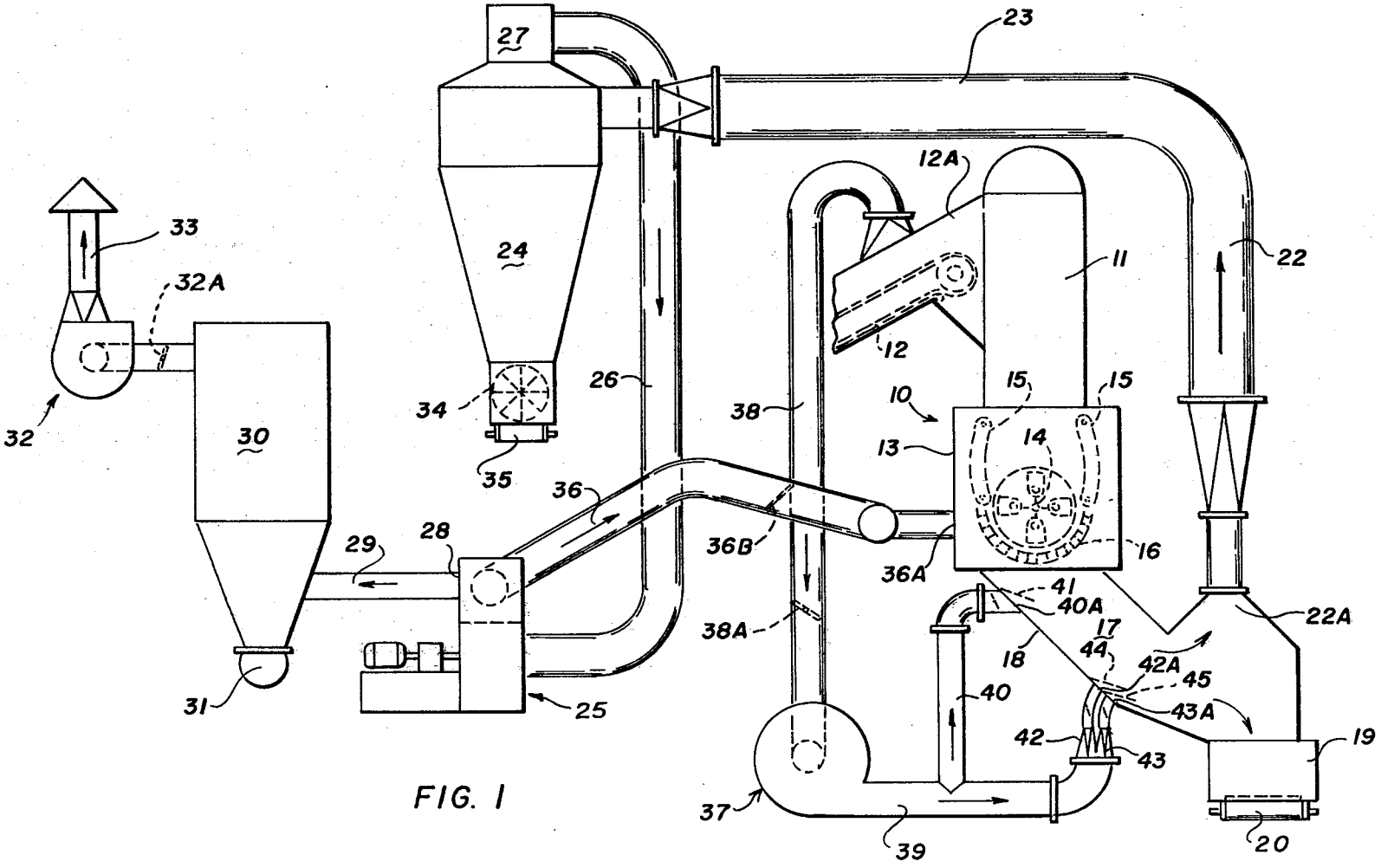
FIG. 1 is an elevational view of the components and operating connections making up the fluid bed separator apparatus.
Figure 2:
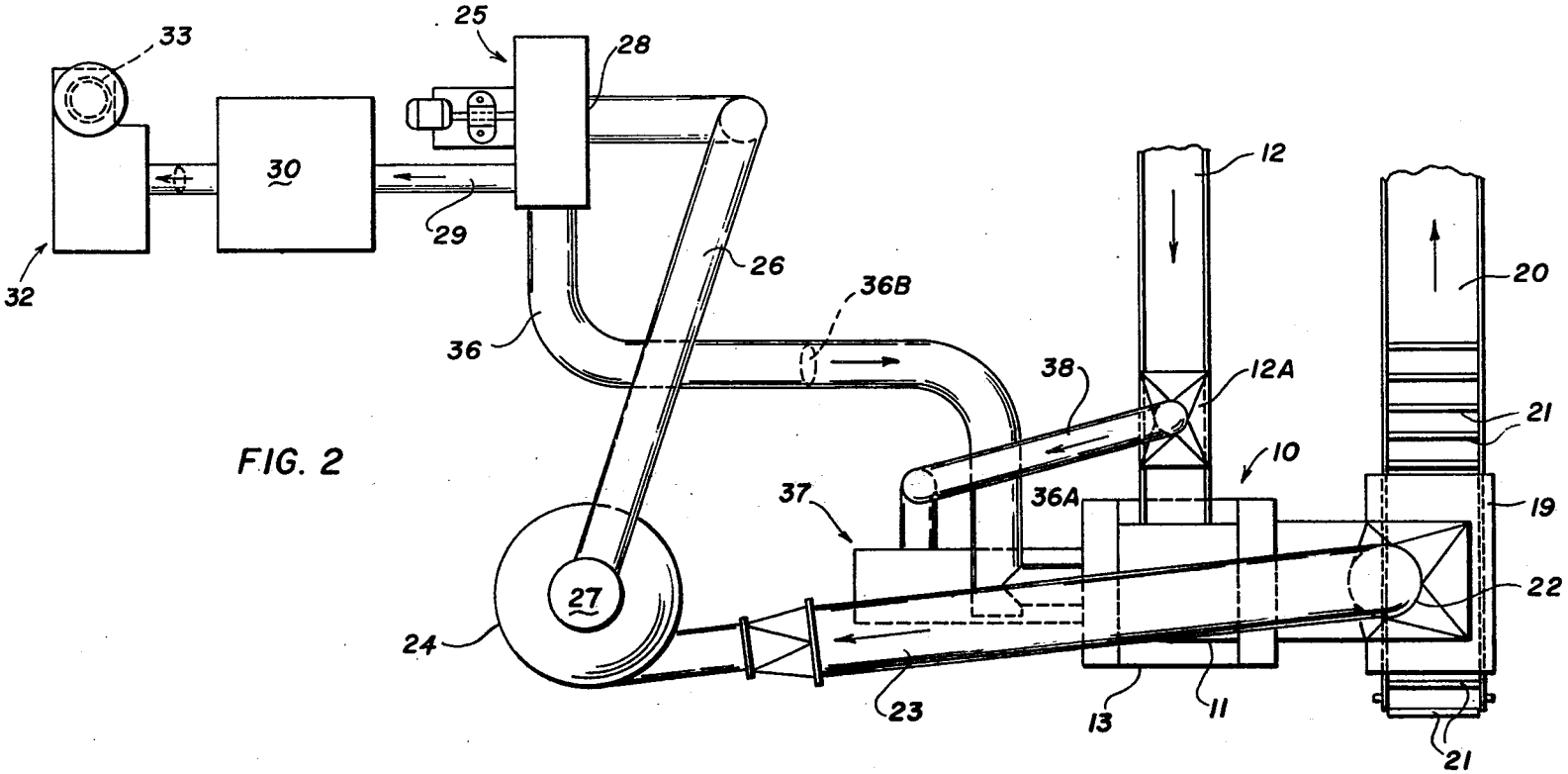
FIG. 2 is a plan view of the layout of the apparatus.

In summary, the system of FIGS. 1 and 2 operates to receive preconditioned waste material to the hopper 11. By preconditioned waste is meant the waste is run through a hammer mill and magnetic separator which reduces the initial size of the waste and gets rid of as much of the magnetic material as possible. That waste is directed by the hopper 11 into a hammer mill structure 10 which shreds and keep on reducing the size of the waste until the air flow entering by way of the hopper 11 can carry the reduced waste through a distributing grate 16 which effects a substantially even spread of material into the elutriating chamber 17. The material in the chamber 17 is additionally acted upon by the introduction of air at the openings 40A, 42A and 43A to keep it stirred up or riffled so the higher specific gravity material will fall down the sloped wall 18 of the chamber 17 to the air lock device 19 where it can be carried away by the conveyor 20. The lighter specific gravity material moves into the inlet throat 22A of the air lift column 22 which is maintained under a substantially constant velocity of air by the action of the blower 25 connected between the cyclone separator 24 and the air conduit 36 supplying air at the inlet 36A, as needed or permitted by the opening response of pressure sensitive valve 36B, as well as by air moved by fan 37 which supplies air to the openings 40A, 42A and 43A to percolate through the waste materials. The air drawn in by fan 37 from the hood 12A over the feed conveyor 12 is regulated by a manually set damper 38A in the conduit 38. If desired, the conduit 38 may be connected into conduit 36 instead of being connected, as shown, to the hood 12A.

The system of FIGS. 1 and 2 is operated in conjunction with a bag house 30 and its exhaust fan 32 so that the system will be at a pressure less than ambient to keep in dust and prevent contamination of the area where the apparatus may be installed. For example, the exhaust fan 32 may handle about one-third of the air moved by blower 25, while two-thirds of the air handled by the blowe is recirculated. The make up air to replace what is exhausted will come from leaks at the conveyor hood 12A and from the air lock device 19. The major portion of air leaked into the system will come from the hood 12A which assures that there will be a flow of air through the hammer mill grate 16 for effecting a substantial even distribution of material raining down into the chamber 17.

In a system sized to handle 40 tons of waste per hour, it is contemplated that the flow in the air lift column would have to be about one thousand cubic feet per minute per ton, or about forty thousand cubic feet per minute. That means that the blower should be sized to recirculate about twenty six thousand cubic feet of air per minute, and the air leakage into the system will supply the remainder to make up for the air exhausted by the bag house fan 32. It is important to operate the apparatus with a low velocity air movement in the chamber 17 so that the burnables which have a lesser specific gravity will easily stay suspended and flow into the throat or inlet 22A of the air lift column, while the nonburnables with a higher specific gravity will drop down into the air lock 19 and be dragged out by the conveyor 20. Should a rapid feed of material into the hopper 11 take place, the hammer mill will act as a feed regulator and continue to shred material and distribute it through the full area of the grate 16 so that the system will have an even rate of discharge from the grate 16. The result is that material reaching the chamber 17 will be in such a fine state of separation, as opposed to sticking together in clumps, that the separation of the burnables from the nonburnables can take place easily and efficiently. The setting of valves 36B and 38B can be selected to obtain a pressure drop of one to two inches of water compared to ambient.

What is claimed is:

1. Fluid bed separator apparatus for processing waste material to recover burnables comprising: a hammer mill having a feed hopper forming an inlet and an elutriating chamber forming an outlet; an air lift column having an inlet connected into said elutriating chamber; a cyclone separator having an inlet connected to said air lift column; a blower having an inlet connected to said cyclone separator and a delivery outlet; conduit means connected between said blower delivery outlet and said hammer mill; a bag house having an inlet connected to said blower delivery outlet; and a fan connected to said bag house to exhaust air to atmosphere and maintain a pressure in said elutriating chamber less than ambient pressure, said blower creating an air flow through said hammer mill and in by-pass of said hammer mill, whereby said material in said hammer mill and elutriating chamber is subject to air movement flowing from said feed hopper to said air lift column.

2. The apparatus of claim 1, wherein air moving means has an inlet connected to said feed hopper and an outlet, and conduit means extending from a connection at said air moving means outlet to said elutriating chamber to deliver air to said chamber for maintaining material in said chamber in motion.

3. Waste material processing apparatus for recovery of the burnable components comprising: a material shredder having an inlet open to a hopper for waste material and an outlet open to an elutriating chamber; an air lift column connected at one end to said elutriating chamber and having an outlet at the opposite end; centrifugal separator means connected to said column opposite end to receive material air lifted from said air lift column; blower means having an inlet connected to said centrifugal separator and a discharge; conduit means connected between said blower discharge means and said material shredder; air moving means connected between said inlet hopper and said elutriating chamber to supply air for riffling the material in said chamber to disassociate light weight material from heavy material and induce light weight material flow toward said air lift column; means connected to said centrifugal separator to receive the light weight material recovered therein; and other means connected to said elutriating chamber to receive the heavy material disassociated in said elutriating chamber from the light material.

4. The apparatus set forth in claim 3 wherein there is means connected to said blower discharge for collecting fines that may be in the air moved by said means for collecting fines for directing air to the atmosphere and reducing the pressure in said hopper and chamber to less than ambient.

5. The apparatus set forth in claim 3 wherein said connection of said air moving means with said elutriating chamber comprising a plurality of openings in spaced relation, and guards positioned adjacent said openings for excluding the entrance of the material shredded by said material shredder.

6. The apparatus set forth in claim 5 wherein valve means is disposed in each of said plurality of openings for regulating the velocity of the air admitted to said chamber, and other valve means is disposed in the connection of said air moving means to said inlet hopper.

7. The apparatus set forth in claim 3, wherein said material shredder includes grate means formed with openings extending over about 180° of arc of said material outlet, and said conduit means connected between said blower discharge and said material shredder connects at a position to direct the air in by pass of said grate.

8. The apparatus set forth in claim 7 wherein valve means is operably mounted in said conduit means connected between said blower discharge and said material shredder, said valve means being responsive to the degree of pressure in said material shredder to supply air around said grate means in the event material blinds the grate openings.

* * * * *